US007575120B2

(12) United States Patent
Beatty

(10) Patent No.: US 7,575,120 B2
(45) Date of Patent: Aug. 18, 2009

(54) ATV HOIST

(76) Inventor: Ronald Beatty, 4483 64th St., SW., Grandville, MI (US) 49418

( * ) Notice: Subject to any disclaimer, the term of this patent is extended or adjusted under 35 U.S.C. 154(b) by 0 days.

(21) Appl. No.: 11/215,885

(22) Filed: Aug. 31, 2005

(65) Prior Publication Data

US 2007/0045211 A1 Mar. 1, 2007

(51) Int. Cl.
*B66C 23/44* (2006.01)

(52) U.S. Cl. ..... 212/180; 414/460

(58) Field of Classification Search ..... 212/180; 414/462

See application file for complete search history.

(56) References Cited

U.S. PATENT DOCUMENTS

| | | | | | |
|---|---|---|---|---|---|
| 734,973 | A * | 7/1903 | Shively | 56/426 |
| 4,069,922 | A * | 1/1978 | Hawkins | 212/181 |
| 4,705,179 | A * | 11/1987 | Lathrum | 212/294 |
| 5,211,297 | A * | 5/1993 | Vandervalk | 212/294 |
| 5,281,078 | A * | 1/1994 | Mills, Jr. | 414/680 |
| 5,662,451 | A | 9/1997 | Muzzi et al. | |
| 5,725,112 | A * | 3/1998 | Thorby | 212/180 |
| 5,853,282 | A * | 12/1998 | Bechler et al. | 414/543 |
| 5,876,019 | A * | 3/1999 | Morrissey et al. | 254/323 |
| 5,934,490 | A * | 8/1999 | Mora | 212/176 |
| 5,975,831 | A * | 11/1999 | Martin | 414/543 |
| 6,371,314 | B1 * | 4/2002 | Boisvert | 212/180 |
| 6,425,727 | B1 * | 7/2002 | Hood | 414/543 |
| 6,612,549 | B1 * | 9/2003 | Woods, Jr. | 254/323 |
| 7,059,955 | B2 * | 6/2006 | Green et al. | 452/189 |
| 2002/0048504 | A1 | 4/2002 | Jacobs | |
| 2004/0237372 | A1 * | 12/2004 | Frye | 42/94 |
| 2005/0173584 | A1 * | 8/2005 | Fletcher et al. | 242/419.4 |
| 2006/0054580 | A1 * | 3/2006 | Sherrod | 212/180 |

* cited by examiner

*Primary Examiner*—Thomas J. Brahan
(74) *Attorney, Agent, or Firm*—Robert J. Sayfie

(57) ABSTRACT

A hoist that is demountably secured to a frame of an all terrain vehicle, comprising a base that is demountably secured to the frame; an arm-base bracket that is secured to a top surface of said base; a base arm that is pivotably mounted to a front portion of said arm-base bracket; a sliding arm that is slidably received by said base arm, said sliding arm having a sliding arm terminal end; a base arm locking member that locks the sliding arm in place relative to said base arm; a sliding arm pulley rotatably secured to said sliding arm terminal end; a support arm adjustably secured at one end to a rear portion of said arm-base bracket, and at the other end to said base arm; and a crank capable of receiving a cable from said sliding arm pulley.

19 Claims, 4 Drawing Sheets

ATV HOIST

BACKGROUND OF THE INVENTION

This invention relates to a hoist that can be secured to an all terrain vehicle (ATV), also known as a quad-runner. More particularly, this invention relates to a hoist that can be secured to the front or rear of an ATV and it can be operated manually or automatically.

ATV's have many uses can traverse rugged terrain, including unpaved areas and forests. Further, ATV's are owned by several consumers for work or recreation. Therefore they may serve useful work purposes in environments such as camping or hunting, and also around the home. To increase the ATV's workhorse function, ATV's have been adapted with carrying or luggage racks, and winches.

U.S. Pat. No. 5,662,451 discloses an ATV hoist with a telescoping vertical support shaft connected to a horizontal boom. The '451 hoist is secured to an ATV rack 52, 54 on one side of the rack 52, 54, as compared with being secured near the width-wise center of the ATV. The width-wise center is defined as the mid-point of the distance from one side (i.e. left) to the other side (i.e. right). The '451 hoist distributes the entire weight of the hoist and the load that the hoist may be carrying, to the vertical shaft section 44 and the support plate 48. The vertical shaft section 44 and the support plate 48 are disposed near the right side, or the left side of the ATV, rather than the center.

U.S. patent application Publication No. 2002/0048504 disclosed an ADV hoist that is secured at two locations on the ATV, near the rack and near the front wheel.

As can be seen, there is a need for an ATV hoist that is easily and securely positioned on either the front or back of the ATV; and an ATV hoist that is positioned in the width-wise center of the ATV so it does not tip leftwardly or rightwardly with a heavy load.

SUMMARY OF THE INVENTION

A hoist that is demountably secured to a frame of an all terrain vehicle, comprising a base that is demountably secured to the frame; an arm-base bracket that is secured to a top surface of said base; a base arm that is pivotably mounted to a front portion of said arm-base bracket; a sliding arm that is slidably received by said base arm, said sliding arm having a sliding arm terminal end; a base arm locking member that locks the sliding arm in place relative to said base arm; a sliding arm pulley rotatably secured to said sliding arm terminal end; a support arm adjustably secured at one end to a rear portion of said arm-base bracket, and at the other end to said base arm; and a crank capable of receiving a cable from said sliding arm pulley.

Another aspect of the invention is a hoist that is demountably secured to a frame of an all terrain vehicle, comprising: a base that is demountably secured to the frame; an arm-base bracket that is secured to a top surface of said base; a base arm that is pivotably mounted to a front portion of said arm-base bracket; a sliding arm that is slidably received by said base arm, said sliding arm having a sliding arm terminal end; a base arm locking member that locks the sliding arm in place relative to said base arm; a sliding arm pulley rotatably secured to said sliding arm terminal end; a support arm adjustably secured at one end to a rear portion of said arm-base bracket, and at the other end to said base arm; a base-frame bracket to adjustably detachably mount said base to the frame; and a crank capable of receiving a cable from said sliding arm pulley.

Yet another aspect of the present invention is a hoist that is demountably secured to a frame of an all terrain vehicle, comprising: a base that is demountably secured to the frame; an arm-base bracket that is secured to a top surface of said base; a base arm that is pivotably mounted to a front portion of said arm-base bracket; a sliding arm that is slidably received by said base arm, said sliding arm having a sliding arm terminal end; a base arm locking member that locks the sliding arm in place relative to said base arm; a sliding arm pulley rotatably secured to said sliding arm terminal end; a support arm adjustably secured at one end to a rear portion of said arm-base bracket, and at the other end to said base arm; a base-frame bracket to adjustably detachably mount said base to the frame; and a winch capable of receiving a cable from said sliding arm pulley.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
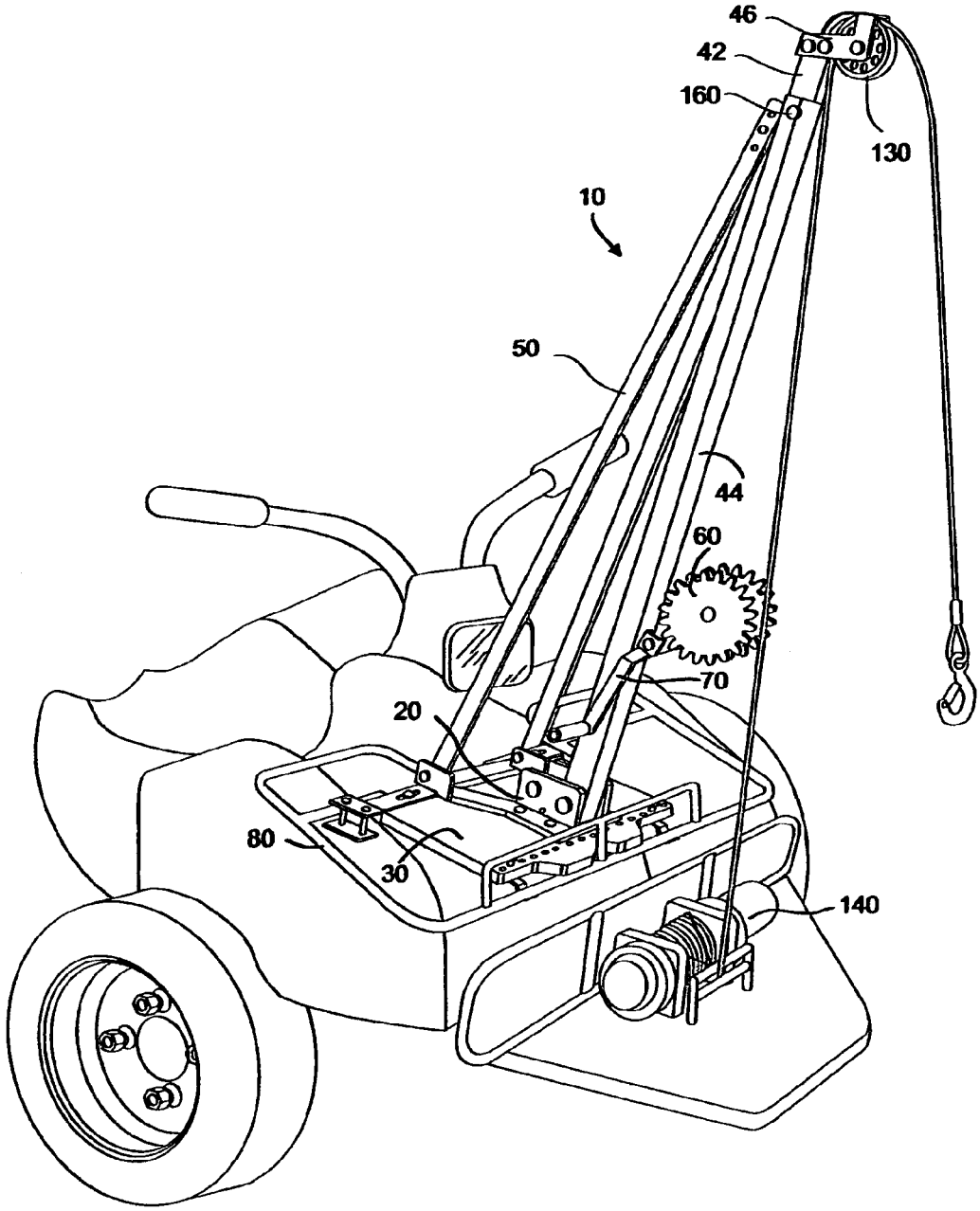
FIG. 1 is a pictorial view of the ATV hoist placed on a front of an ATV.
Figure 3:
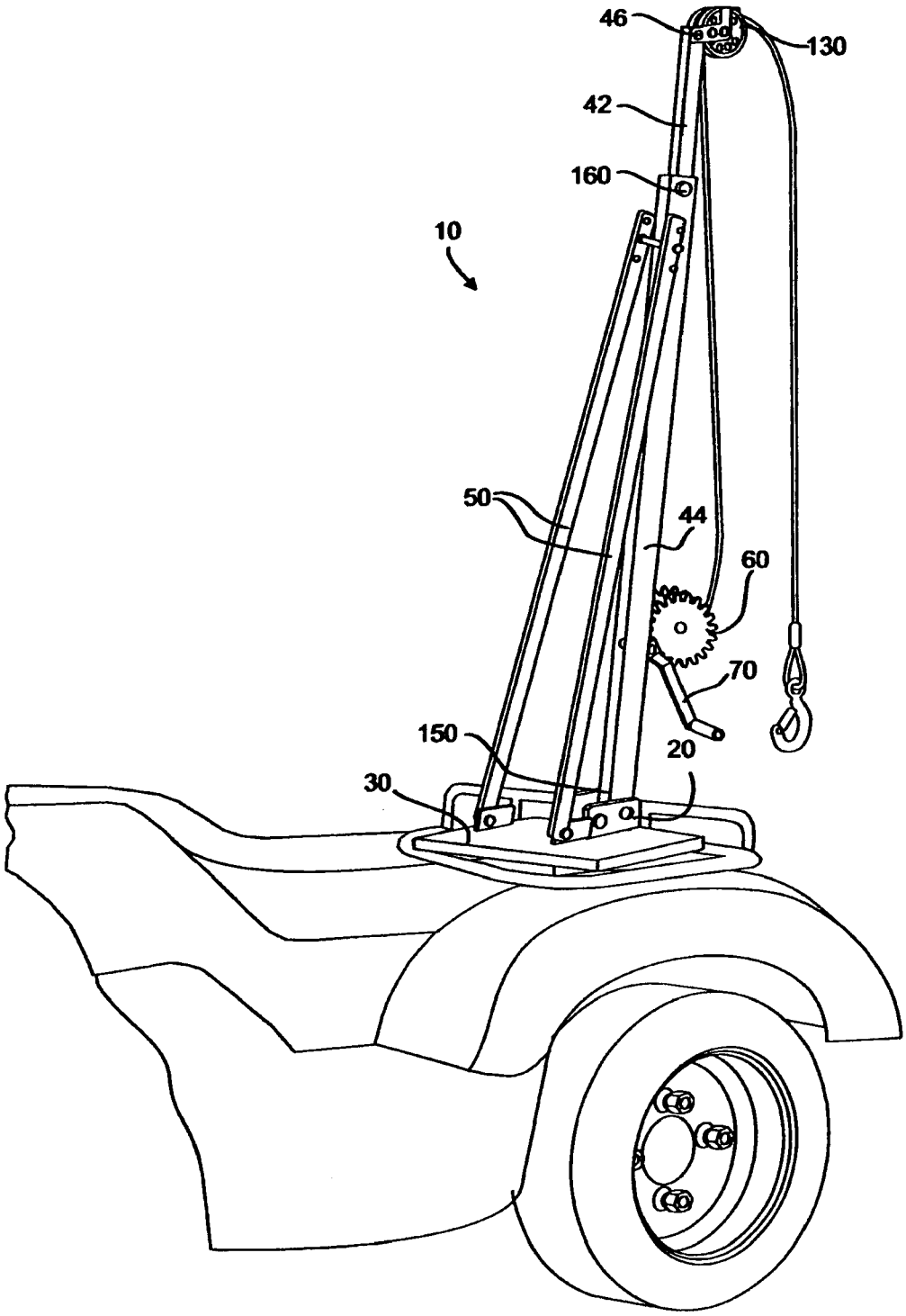
FIG. 3 is a pictorial view showing the ATV hoist secured to the rear of an ATV.

FIG. 1 illustrates the ATV hoist 10 secured to a frame 80 that is on the front of the ATV. A base 30 is secured to a frame 80 via a base-frame bracket 90 as seen in FIG. 3. The base-frame bracket 90 is adjustable to enable the base 30 to be able to be secured to the frame 80 at relatively different positions, or with frames 80 that are of a varied configuration. In one exemplary embodiment the bracket 90 is equipped with a base-frame bracket sliding means 92, or a base-frame bracket pivot means 94, or both 92, 94.

Figure 2:
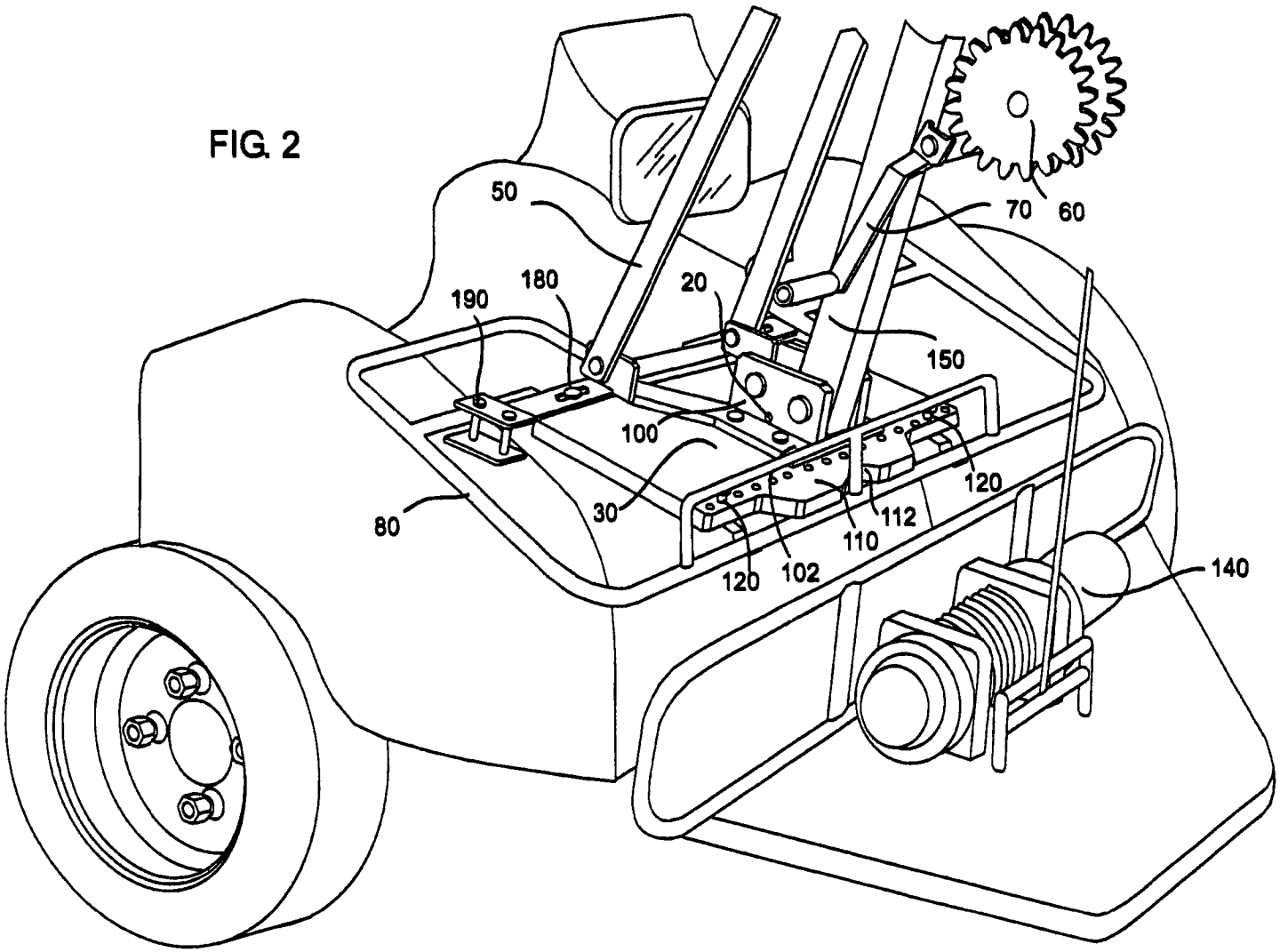
FIG. 2 is essentially a closer view of FIG. 1.
Figure 4:
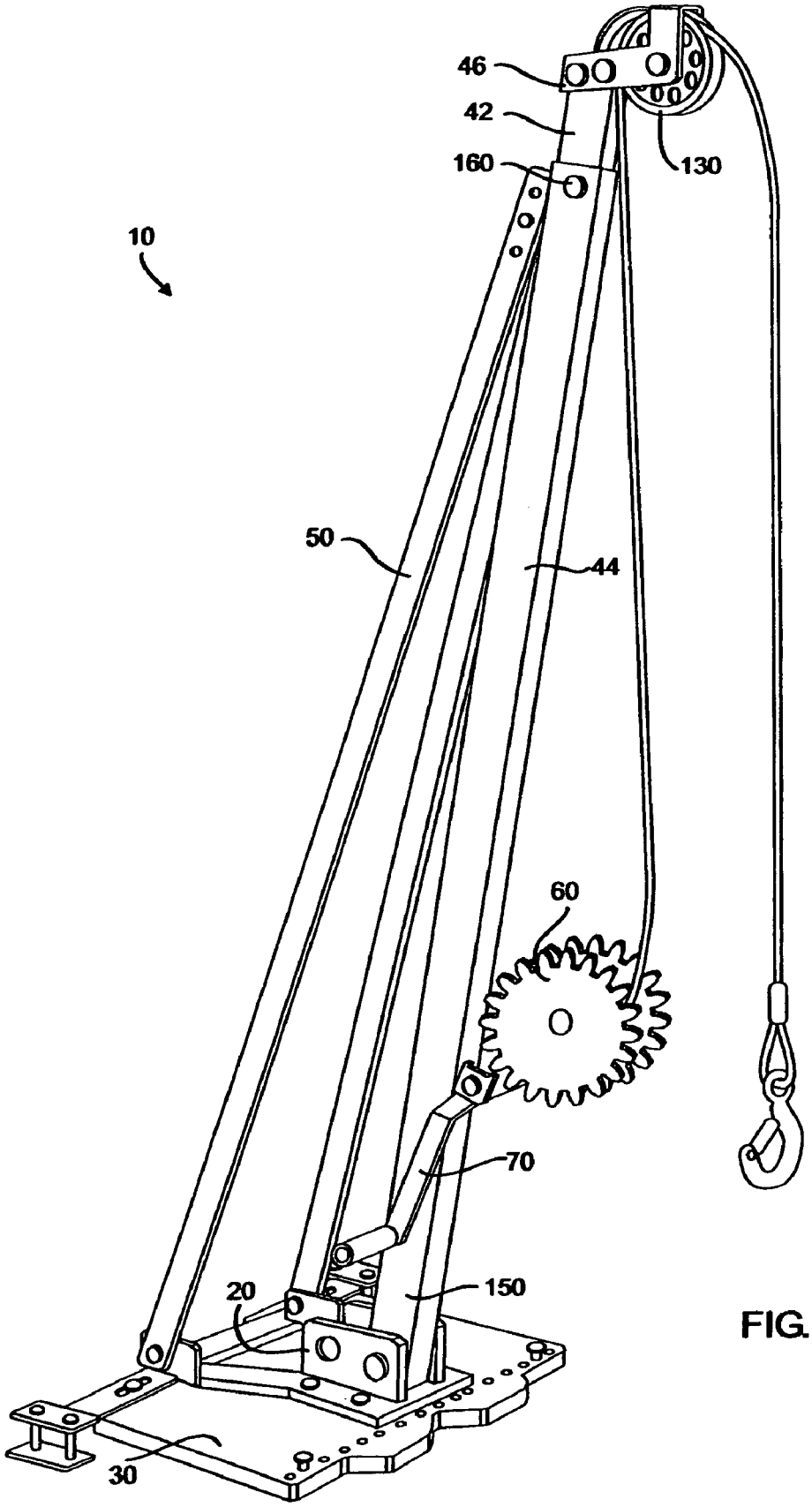
FIG. 4 is a pictorial view of the ATV hoist removed from the ATV.

As illustrated in FIG. 2, a locking member 120 may engage the base 30 with the frame 80. In one exemplary embodiment the locking member 120 is an alan wrench fastener that goes through a bore (not shown) in the base, and is threadably engaged with the frame 80 (not shown). FIG. 4 also illustrates two base extending portions 110 spaced apart to define a base web 112. The base web 112 may fit around a vertically oriented portion or shaft of the frame 80. The base web 112, locking member 120, and base-frame bracket 90 may all be utilized together, or separate, to secure the base 30 to the frame 80 of the ATV at either the front or the rear (as illustrated in FIG. 5).

FIG. 1 further illustrates an arm-base bracket 20 that is secured to the base 30. Near a rear portion of the base 30 and arm-base bracket 20, a support arm 50 may be secured to the arm-base bracket 20. The support arm extending away from said base 30 in a generally upwardly direction to be adjustably pivotably and demountably secured to a stationary arm or base arm 44 of a telescoping assembly arm 40 to prevent the base arm 44 from pivoting freely about the base arms 44 pivotably securement to a front portion of the arm-base bracket 20.

As further illustrated in FIG. 1, a proximal end 150 of the telescoping assembly arm 40 is pivotally secured to the arm-base bracket 20 near a front portion (closer to the base extending portion 110 than the rear portion). The telescoping assembly arm 40 extends away from the base 30 and may comprise a stationary arm or base arm 44 and a sliding arm 42. The sliding arm 42 may adjustably slide or telescope within the base arm 44. The sliding arm 42 may have a telescoping arm terminal end 46, which may be positioned by sliding the sliding arm 42 within the base arm 44, and then locking the sliding arm 42 relative to the base arm 44 by a telescoping assembly arm locking member 160. In one exemplary embodiment the telescoping arm locking member 160 is a locking pin that is received through apertures (not shown) of the base arm 44 and the sliding arm 42.

The telescoping arm terminal end 46 may have a telescoping arm pulley 130, also referred to as a sliding arm pulley 130, rotatably secured near or at the telescoping arm terminal end 46. The telescoping arm pulley 130 may receive a cable so that the cable may also be received and securely pulled by either a manual crank 60 that is rotatably secured to the base arm 44, or in an alternative embodiment, the cable may be received my a motorized winch 140. Use of both the manual crank 60 and the motorized winch 140 is usually unnecessary, and the user may choose one of the two 60, 140. In one exemplary embodiment the manual crank 60 is a ratchet and pawl crank that locks in one direction, for example, when lifting a heavy object, and can be released when the cable may want to be "let out" or extended, or unwound. FIG. 1 illustrates the manual crank 60 having a crank handle 70. The motorized winch 140 is also shown in FIG. 2.

FIG. 1 illustrates the arm-base bracket 20 having an L-shape, with one leg 110 securing to the arm-base bracket 20 to the base 30; and the other leg 100 pivotably securing the proximal end 150 of the base arm 44 to the arm-base bracket 20. FIG. 1 further illustrates the base-frame bracket sliding means 92 may comprise an elongate slot 170 and a bolt 180 to secure the base-frame bracket 90 to the base 30. Further, the base-frame bracket pivoting means 94 may comprise a fastener that pivotably secures the member of the bracket 90 that comprises the base-frame pivoting means 94 to the member of the bracket that comprises a bracket-frame fastener 190, which releasably secures the bracket 90 to the frame 80.

FIG. 2 illustrates how the two base extending portions 110 define a base web 112 therebetween. The two base extending portions 110 allow a vertically oriented portion of the frame 80 to extend therebetween to provide a template form of placement for the base 30 relative to the frame 80. FIG. 2 further illustrates a locking pin 120 which may secure the base 30 to the frame 80 by being disposed in apertures of the base 30, and being threadably engaged with a portion of the frame 80.

FIG. 3 illustrates the present invention 10 being secured to a frame 80 that is positioned on the rear of the ATV. FIG. 3 illustrates a crank 60 that is capable of receiving and displacing a cable.

FIG. 4 illustrates the present invention 10 demounted from the base 80 (not shown in this Figure). As illustrated in FIG. 6, the present invention 10, including the base 30, arm-base bracket 20, and base frame bracket 90 may be one unitary device, capable of easily demounting and mounting to a frame 80 (not shown in this Figure) of the ATV. Further, as seen in FIGS. 3 and 4, the cable extends upwardly and substantially vertically from the crank 60 to the sliding arm pulley 130. However in FIG. 1, the cable extends from the winch 140.

A switch may be operably connected to control the operation of the winch, including on-off functions, and rotational direction functions, and speed of rotation functions.

Although the crank 60 may be interpreted as being a manual crank, this term may also include a motorized crank, such as the motorized winch 140 described herein. In other words the crank 60 may be either manual or motorized.

It should be understood, of course, that the foregoing relates to exemplary embodiments of the invention and that modifications may be made without departing from the spirit and scope of the invention as set forth in the following claims.

I claim:

1. A hoist that is demountably secured to a frame of an all terrain vehicle, comprising:

a base that is demountably secured to the frame of the all terrain vehicle;

an arm-base bracket that is secured to a top surface of said base;

a base arm that is pivotably mounted to a front portion of said arm-base bracket, said base arm oriented in a substantially vertical position;

a sliding arm that is slidably received by said base arm, said sliding arm having a sliding arm terminal end;

a base arm locking member that locks the sliding arm in place relative to said base arm;

a sliding arm pulley rotatably secured to said sliding arm terminal end;

a support arm adjustably secured at one end to a rear portion of said arm-base bracket, and at the other end to said base arm, said support arm oriented in a substantially vertical position; and a crank including a cable from said sliding arm pulley;

wherein said cable is capable of extending from said crank upwardly and substantially vertically to said sliding arm pulley; and then said cable extending over said sliding arm pulley in a downward and substantially vertical direction.

2. The hoist of claim 1, further comprising:

a base-frame bracket to adjustably detachably mount said base to the frame.

3. The hoist of claim 2, wherein said base-frame bracket comprises a first member having an elongate slot and a bolt to removably secure said base-frame bracket to said frame, and said base-frame bracket comprising a second member that is pivotably secured to said first member, and said second member comprising a bracket-frame fastener to secure said bracket to the frame.

4. The hoist of claim 1, further comprising:

a locking pin that removably secures said base to the frame.

5. The hoist of claim 1, further comprising:

two base extending portions that are separated by a base web, said base web capable of receiving part of the frame therebetween.

6. The hoist of claim 1, wherein said crank is a ratchet and pawl crank that is capable of single direction rotation when lifting a load, and is secured to said base arm.

7. The hoist of claim 1, further comprising a switch to electronically control a motorized winch to displace a cable that is received by said sliding arm pulley, by rotating said motorized winch.

8. A hoist that is demountably secured to a frame of an all terrain vehicle, comprising:

a base that is demountably secured to the frame of an all terrain vehicle;

an arm-base bracket that is secured to a top surface of said base;

a base arm that is pivotably mounted to a front portion of said arm-base bracket, said base arm oriented in a substantially vertical position;

a sliding arm that is slidably received by said base arm, said sliding arm having a sliding arm terminal end;

a base arm locking member that locks the sliding arm in place relative to said base arm;

a sliding arm pulley rotatably secured to said sliding arm terminal end;

a support arm adjustably secured at one end to a rear portion of said arm-base bracket, and at the other end to said base arm, said support arm oriented in a substantially vertical position;

a base-frame bracket to adjustably detachably mount said base to the frame; and a crank rotatably secured to said base arm and including a cable from said sliding arm pulley, wherein said cable is capable of extending from said crank upwardly and substantially vertically to said sliding arm pulley; and then said cable extending over said sliding arm pulley in a downward and substantially vertical direction.

9. The hoist of claim 8, further comprising:

a locking pin that removably secures said base to the frame.

10. The hoist of claim 8, further comprising:

two base extending portions that are separated by a base web, said base web capable of receiving part of the frame therebetween.

11. The hoist of claim 8, wherein said base-frame bracket comprises a first member having an elongate slot and a bolt to removably secure said base-frame bracket to said frame, and said base-frame bracket comprising a second member that is pivotably secured to said first member, and said second member comprising a bracket-frame fastener to secure said bracket to the frame.

12. The hoist of claim 8, wherein said crank is a ratchet and pawl crank that is capable of single direction rotation when lifting a load.

13. The hoist of claim 8, further comprising a switch to electronically control a motorized winch to displace a cable that is connected to said winch and that is received by said sliding arm pulley.

14. A hoist that is demountably secured to a frame of an all terrain vehicle, comprising:

a base that is demountably secured to the frame of an all terrain vehicle;

an arm-base bracket that is secured to a top surface of said base;

a base arm that is pivotably mounted to a front portion of an arm-base bracket;

a sliding arm that is slidably received by said base arm, said sliding arm having a sliding arm terminal end;

a base arm locking member that locks the sliding arm in place relative to said base arm, said base arm oriented in a substantially vertical position;

a sliding arm pulley rotatably secured to said sliding arm terminal end;

a support arm adjustably secured at one end to a rear portion of said arm-base bracket, and at the other end to said base arm, said support arm oriented in a substantially vertical position;

a base-frame bracket to adjustably detachably mount said base to the frame; and a winch including a cable from said sliding arm pulley, wherein said cable is capable of extending from said winch in an upwardly direction relative to said sliding arm pulley; and then said cable extending over said sliding arm pulley in a downward and direction.

15. The hoist of claim 14, further comprising:

a locking pin that removably secures said base to the frame.

16. The hoist of claim 14, further comprising:

two base extending portions that are separated by a base web, said base web capable of receiving part of the frame therebetween.

17. The hoist of claim 14, wherein said base-frame bracket comprises a first member having an elongate slot and a bolt to removably secure said base-frame bracket to said frame, and said base-frame bracket comprising a second member that is pivotably secured to said first member, and said second member comprising a bracket-frame fastener to secure said bracket to the frame.

18. The hoist of claim 14, further comprising a crank that is secured to said base arm, and said crank is capable of receiving a cable from said sliding arm pulley.

19. The hoist of claim 14, further comprising a switch to electronically control a motorized winch to displace a cable that is received by said sliding arm pulley.

* * * * *